US005156145A

United States Patent [19]

Flood et al.

[11] Patent Number: 5,156,145

[45] Date of Patent: Oct. 20, 1992

[54] SELF-CONTAINED BREATHING SYSTEM APPARATUS WITH AUTOMATIC BACK-UP

[75] Inventors: Michael G. Flood, Spring; Gene C. Ardoin, Kingwood, both of Tex.

[73] Assignee: Life Support Technology Corporation, Houston, Tex.

[21] Appl. No.: 272,978

[22] Filed: Nov. 17, 1988

[51] Int. Cl.[5] ..... A62B 17/04

[52] U.S. Cl. ..... 128/201.24; 128/204.26; 128/205.24; 128/204.18

[58] Field of Search ..... 128/201.24, 201.28, 128/202.22, 204.26, 205.23, 205.24, 204.18

[56] References Cited

U.S. PATENT DOCUMENTS

| | | | |
|---|---|---|---|
| 2,764,151 | 9/1956 | Cupp | 128/204.26 |
| 2,854,001 | 9/1958 | Humblet | 128/202.22 |
| 3,362,403 | 1/1968 | Fleming et al. | 128/201.24 |
| 3,433,222 | 3/1969 | Pinto | 128/202.27 |
| 3,473,166 | 10/1969 | Lobelle | 128/201.24 |
| 3,761,959 | 10/1973 | Dunning | 2/3 R |
| 3,957,044 | 5/1976 | Fletcher | 128/204.26 |
| 3,995,626 | 12/1976 | Pearce, Jr. | 128/205.24 |
| 4,035,846 | 7/1977 | Jencks | 2/413 |
| 4,176,418 | 12/1979 | Scott | 128/202.22 |
| 4,186,735 | 2/1980 | Henneman et al. | 128/204.26 |
| 4,328,798 | 5/1982 | Isaacson | 128/204.26 |
| 4,449,524 | 5/1984 | Gray | 128/202.27 |
| 4,498,471 | 2/1985 | Kranz et al. | 128/202.22 |
| 4,581,776 | 4/1986 | Kie | 2/425 |
| 4,586,200 | 5/1986 | Poon | 2/413 |
| 4,750,485 | 6/1988 | Bartos | 128/204.26 |

FOREIGN PATENT DOCUMENTS 949221 2/1964 United Kingdom .

*Primary Examiner*—Edgar S. Burr
*Assistant Examiner*—Aaron J. Lewis
*Attorney, Agent, or Firm*—Henderson & Sturm

[57] ABSTRACT

The self-contained breathing apparatus for use in a noxious or oxygen-deficient atmosphere with redundant first stage pressure reducers and redundant second stage demand regulators which together serve as an automatic by-pass control in the event of a failure in the closed position of a first stage pressure reducer or a second stage demand regulator. A helmet with a face mask and inflatable helmet adjusting device for sizing the helmet to the user's head, provided impact protection and applying pressure to the back of the head causing the face to come into contact with the face mask resulting in the air-tight enclosure of the user's face in the oral-nasal area of the helmet. An integral pump and valve mechanism located in the helmet and operated by pushing on a bulb with the thumb or forefinger compresses air into a bladder thereby sizing the helmet and forming the air-tight seal of the face mask to the user's face. A combination manually operated pump, suction valve and relief valve permit ambient air to be compressed into the helmet bladder without leakage while excess pressure is discharged by depressing the relief valve on the helmet exterior.

2 Claims, 3 Drawing Sheets

SELF-CONTAINED BREATHING SYSTEM APPARATUS WITH AUTOMATIC BACK-UP

BACKGROUND AND SUMMARY OF THE INVENTION

The invention relates to a breathing apparatus and more particularly to a self-contained portable breathing apparatus for temporary use by a wearer in a noxious or oxygen-deficient atmosphere. Such apparatus are worn by fire fighters or industrial workers when exposed to smoke, oxygen deficiency or noxious gases. Portable breathing apparatus of this kind are generally of the open circuit type.

In the typical open circuit breathing device, compressed breathing gas is delivered to the wearer and the expired gases are vented to the atmosphere. The compressed breathing gas is stored in a cylinder which is attached to a harness assembly on the wearer's back.

The breathing gas is reduced to a low, breathable pressure in a two stage process. A first stage pressure regulator reduces the cylinder breathing gas and delivers it to the second stage demand regulator. The demand regulator reduces the breathing gas pressure to near atmospheric and delivers it to the face mask to meet the demand of the user.

In such breathing apparatus, manually operated override valves sometimes referred to as "by-pass" controls are often used to safeguard against a failure in the closed position of the first stage pressure reducer or second stage demand regulator. Such a failure without a "by-pass" control device would prevent breathing gas from being delivered to the user's face mask.

Typically, prior breathing systems feature a face mask which is uncomfortable and cumbersome to the wearer, and while some of the more modern systems have utilized a helmet with a face mask the methods for sealing the face to the mask have attendant disadvantages. While some types of helmets provide inflatable devices of various designs for sizing the helmet and cushioning an impact, the present invention provides the novelty of an integral pneumatic pump and valving mechanism obviating the need for an external compressed gas source.

SUMMARY OF THE INVENTION

According to the present invention there is provided an improved portable breathing system of the open circuit type. Important features of the system are redundant first stage pressure reducers and redundant second stage demand regulators which together serve as automatic by-pass controls.

The high-pressure cylinder breathing gas is regulated by redundant primary and secondary pressure reducers which are mounted in a single housing. The secondary reducer being an automatic back-up to the primary reducer. Primary and secondary reducer outlets on the housing are connected by tubing to redundant primary and secondary demand regulators. The demand regulators, mounted in a helmet, provide breathing gas at near atmospheric pressure to the oral-nasal area. The secondary demand regulator is an automatic back-up to the primary demand regulator. The oral-nasal area is sometimes referred to as the face mask or face piece.

More specifically, the two demand regulators operate at a differential pressure. The primary regulator is set to maintain a higher pressure in the oral-nasal area of the helmet than the secondary regulator. The differential operating pressure results in the secondary regulator remaining in a "stand-by" mode. In the event of a failure in the closed position to either the primary pressure reducer or primary demand regulator the secondary demand regulator senses the pressure change in the oral-nasal area of the helmet and automatically operates to meet user breathing demand.

The hands-free operation and redundant design of the breathing system is an important feature of the present invention.

Another important feature of the invention resides in the provisions of a molded and rugged helmet with a flexible face mask which gives the wearer complete head protection and further in the provision for an enlarged area in the helmet in proximity to the user's ears which when combined with the feature of a pneumatic helmet size adjustment provides high-percentile user fit.

Another important feature of the invention resides in the provision for an integral, manually operated, pneumatic pump which inflates a bladder in the back section of the helmet. The inflated bladder adjusts the helmet to the wearer's head and provides impact protection between the head and the helmet shell.

A further important feature of the invention resides in the provision for an inflated bladder to apply pressure to the back of the wearer's head causing the face to come in contact with the helmet face mask. This action results in the air-tight enclosure of the wearer's face in the oral-nasal area of the helmet.

A still further important feature of the invention resides in the pump mechanism which is recessed in the after section of the helmet. The pump is operated by pushing against a diaphragm with the thumb or forefinger. Each stroke of the pump mechanism compresses air into the bladder thereby sizing the helmet to the wearer's head, provides impact protection and forms the air-tight seal of the face mask to the wearer's face. Escape of air from the bladder is prevented by the pump's check valve mechanism. Excess air pressure is discharged to atmosphere by depressing a relief valve located in the helmet reverse section.

Yet another feature of the invention resides in the provision for a backpack assembly with a frame contoured to the user's back, mounted on which are the redundant pressure reducers, harness and compressed breathing gas cylinder.

DETAILED DESCRIPTION OF A PREFERRED EMBODIMENT OF THE INVENTION

Figure 1:
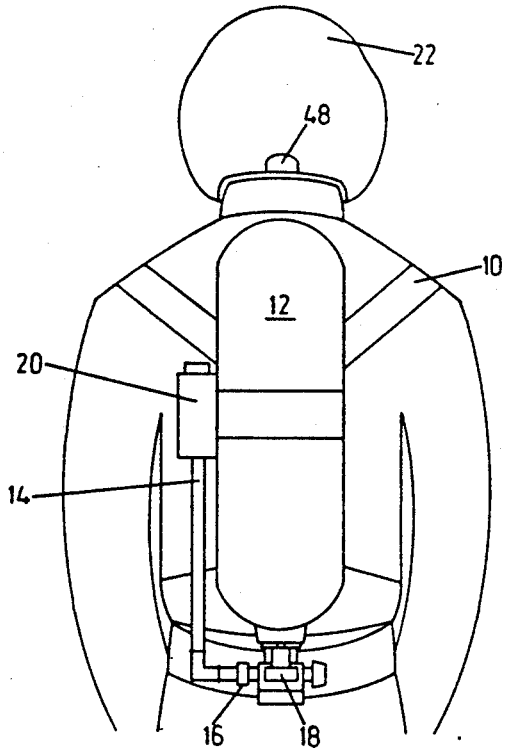
FIG. 1 is a rear view of the system structure as carried on the back of a user.

Reference will be had first to FIG. 1 for an overview of what is involved. In that figure a user or wearer is seen as equipped with a suitable back pack harness 10, appropriately contoured for comfort and flexibility. This harness carries a tank 12 of appropriate breathing gas, such as compressed air, at a pressure of approximately 4500 psi and in quantity sufficient to last under normal circumstances for between thirty and sixty minutes. A high-pressure line 14 is connected to the bottom of the tank by a coupling 16 associated with a pressure gage 18. The line 14 leads to a housing 20 carried alongside the tank and this housing contains components of the system as will be described subsequently. The user is seen as wearing a helmet 22 which is not only a protective device but also contains components of the system, also to appear subsequently in connection with the description of FIG. 6.

FIGS. 2, 3, 4 and 5 show the details of the helmet, here composed of front and rear parts 24 and 26 and having right and left sides 28 and 30. The front and rear parts are in the form of "half-shells" and complement each other when closed about a transverse hinge 32 at the top of the helmet. Suitable releasable means 34 are provided at opposite sides of the helmet for securely interconnecting the helmet parts when closed. The helmet contains therewithin a face mask 36 which provides an oral-nasal cavity 38 made up of a ring-like element 40 of suitable relatively soft material adapted to seal against the frontal part of the user's face and surrounding a transparent front panel 42 through which the user sees ahead. The face mask is sealed against the front of the user's face by means of a bladder 44 secured within the interior of the rear part of the helmet and adapted to act on the occipital region of the user's head when inflated by a pump and valve means 46 preferably located at a rear part of the helmet convenient to the user's hand. The pump may be of a simple type, such as a flexible bulb operated by the user's forefinger via an opening 48 in the helmet in register with the pump. Any suitable release valve (not shown) may be provided to exhaust the bladder for easy removal of the helmet as well as providing adjustability for users' heads of various sizes. The inflated bladder also adds to user comfort and provides impact protection to the user.

Figure 5:
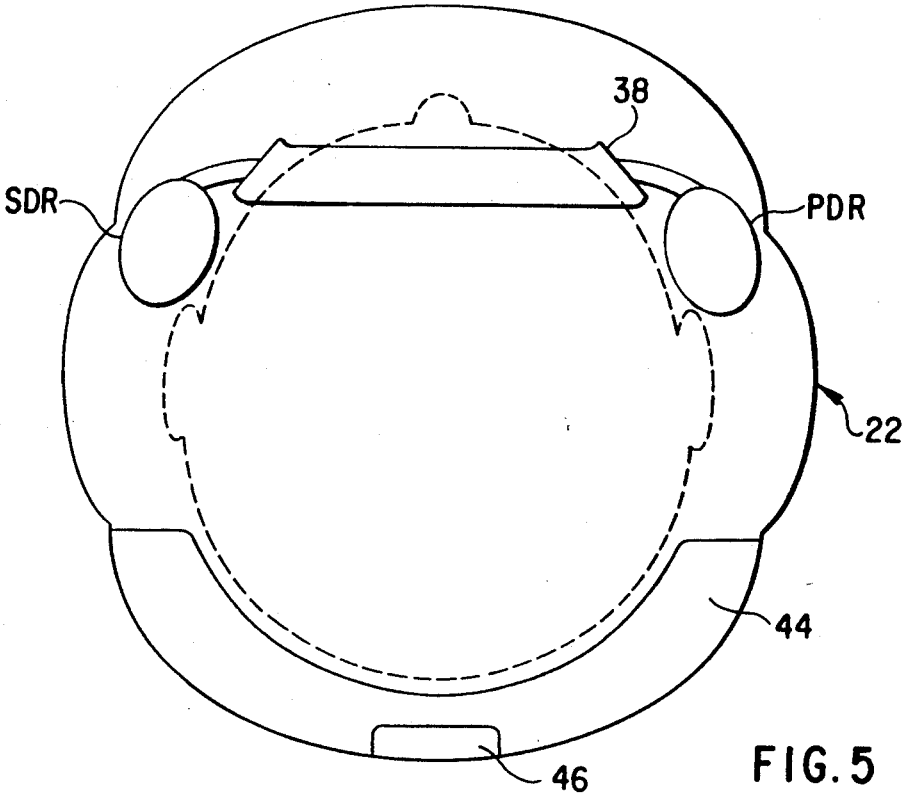
FIG. 5 is a plan schematic of the helmet.

As seen best in FIG. 5, the bladder extends around the back of the helmet and spaces the helmet sides out from the user's ears, further providing a contribution to wearer comfort. Additionally, the sides of the helmet support those system components consisting of the demand regulators. Suitable conduits interconnect these regulators with other system components (FIG. 6).

Figure 6:
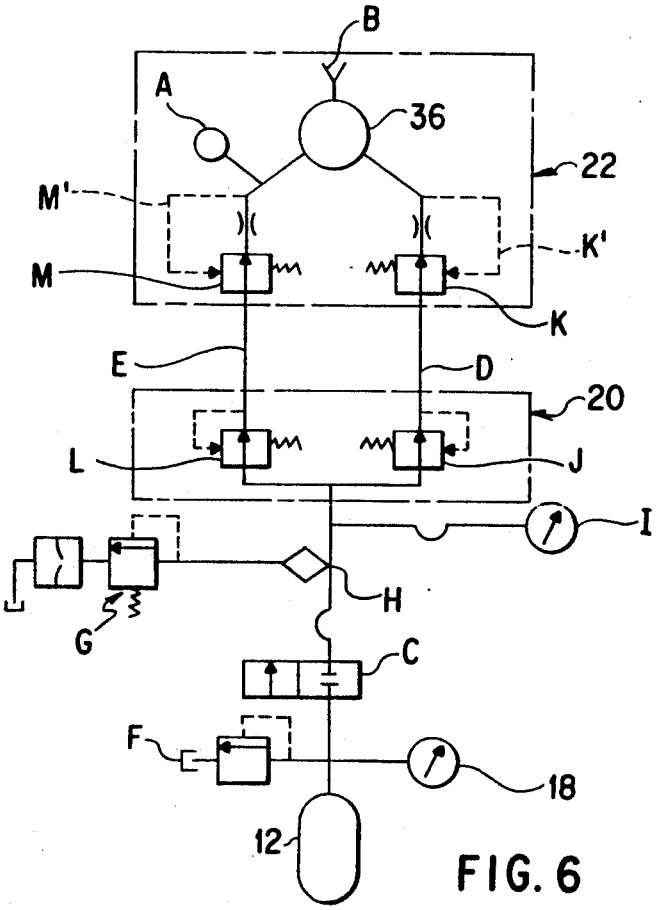
FIG. 6 is a schematic diagram of the system circuit.

In FIG. 6 the components are represented by typical symbols and are appropriately identified by reference numerals, the assumption being made that the components are or may be conventional and thus familiar to those versed in the art. For example, a purge valve is shown at A and an exhalation valve at B.

The tank is of steel or equivalent and contains a supply of breathing gas such as air at a pressure of, say, 4500 psi and has a shut-off valve C at its outlet which leads ultimately to the primary and secondary lines D and E, including a rupture disc unit F and pressure alarm G, filter H and remote gage I. The pressure alarm may be set to sound when the tank supply drops to about one-quarter full. As shown, the tank gage 18 is located between the tank outlet and the shut-off valve.

Figure 2:
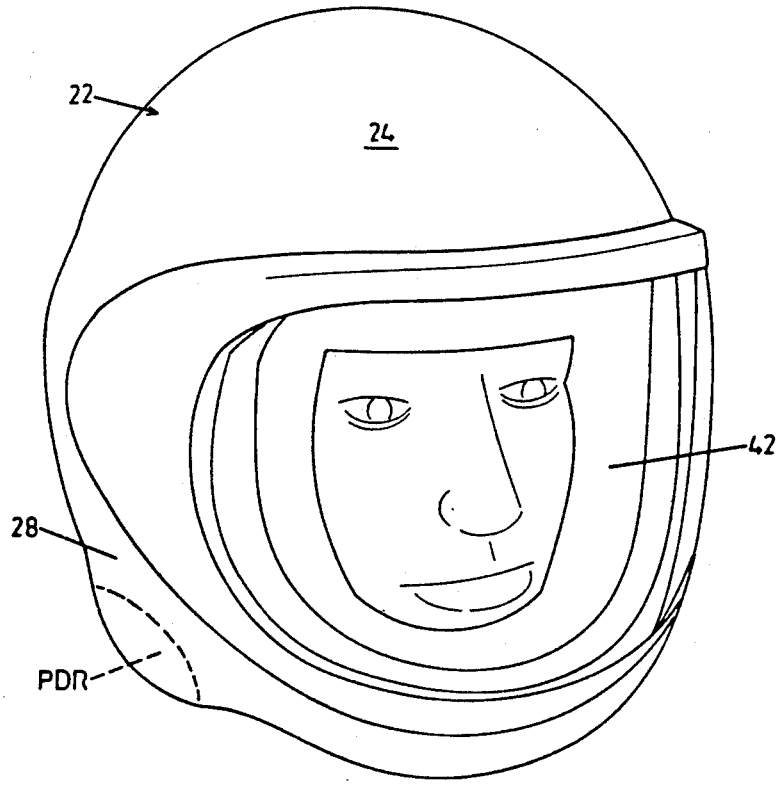
FIG. 2 is a three-quarter front perspective of the helmet.
Figure 4:
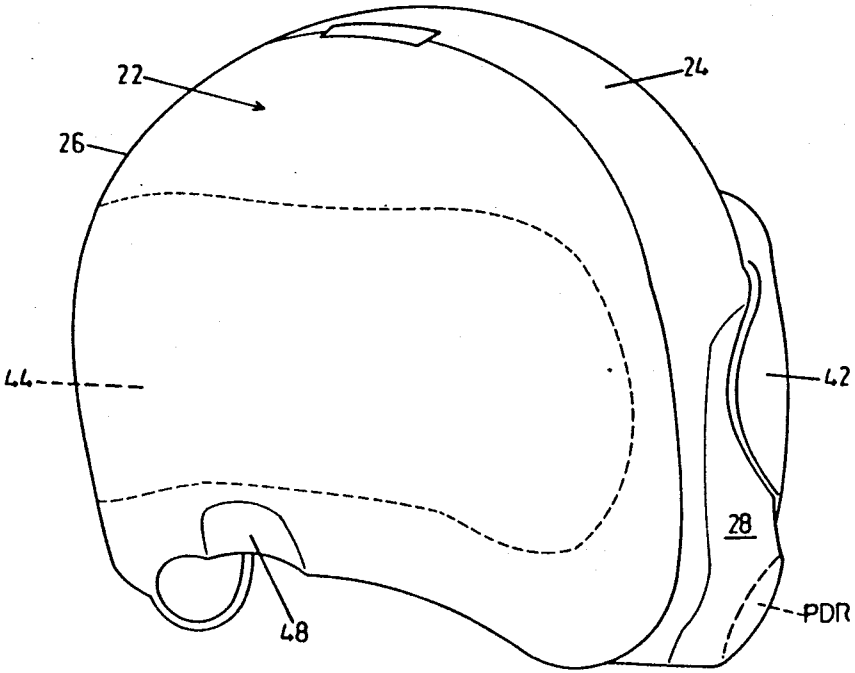
FIG. 4 is a three-quarter rear perspective of the helmet.
Figure 3:
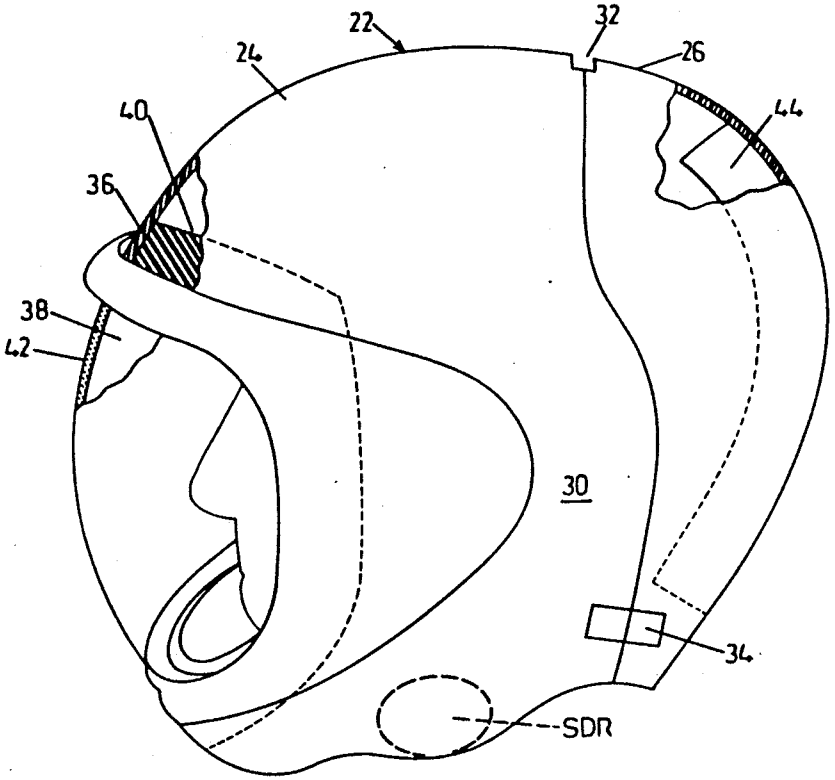
FIG. 3 is a side perspective of the helmet.

The primary line leads ultimately to the face mask 36 and includes pressure-reducing means of the two-stage type, having a primary pressure reducer J and primary demand regulator K in series, these being shown by way of typical symbols. The secondary line is similarly provided with two-stage reducing means comprising a secondary pressure reducer L and a secondary demand regulator M. The two pressure reducers may be contained within the housing 20, and the two demand regulators are carried at opposite sides of the helmet in symmetrical fashion. See FIG. 5. In FIGS. 2 and 4, the dotted ovals designated PDR denote the location of the primary demand regulator. The location of the secondary demand regulator is represented in FIG. 3 by the dotted oval SDR. The face mask has a typical exhalation valve which is spring-loaded to retain face mask pressure at, say, two inches w.c. Upon exhalation by the face mask wearer, face mask pressure exceeds this pressure and the exhalation valve opens. In the present case the system is of the open-loop type and exhalation is discharged to ambient.

Considering now the primary side of the system, i.e. the primary line and its two-stage reducing means JK, the primary pressure reducer is calibrated to reduce tank pressure to 100 psi and, as aforesaid, the primary sensor K' of the demand regulator unit K results in the primary regulator pressure to the face mask at two inches w.c., a safe breathing pressure. This enables normal operation of the overall system. The secondary pressure reducer L is also calibrated to reduce tank pressure to 100 psi but is normally ineffective as a face mask supply because of the intervention of the secondary pressure regulator which responds via the secondary sensor M' to a face mask pressure lower than that of the primary regulator, in this case about one inch w.c. In the event of failure closed of the primary line, the secondary line becomes automatically effective to supply face mask air and thus obviates the need for manual control and its attendant disadvantages as noted above herein.

The purge valve A, when opened manually as a test, for example, before the user's donning the equipment, provides a constant flow of approximately 175 SLPM.

The improved system is intended for easy incorporation into a typical back-pack unit such as shown in FIG. 1 and the components may be located in such positions as to keep the unit simple and comfortable. The elimination of a manual change-over also frees the user's hands for other functions and relieves the user from the concern of what to do should the primary side fail.

Features and advantages additional to those pointed out will readily occur to those versed in the art, as will many variations in the disclosed embodiment, all without departure from the spirit and scope of the invention.

I claim:

1. A self-contained breathing apparatus having a pressurized tank for supplying breathing gas to a face mask, characterized by primary and secondary breathing gas lines arranged in parallel and respectively having inlet ends connected to the tank and outlet ends connected to the face mask, primary and secondary pressure-reducing and regulating means respectively in the primary and secondary lines for reducing tank pressure to a usable pressure in the face mask, said primary means being responsive to face mask pressure of a predetermined value to effect face mask breathing gas supply normally by the primary line exclusively of the secondary line, and said secondary means being responsive to face mask pressure of a predetermined lower value for automatically activating the secondary line to supply breathing air to the face mask in the event of malfunctioning of the primary line, said primary means including a primary pressure reducer downstream of the tank and a primary pressure regulator intermediate the reducer and the face mask, said secondary means including a secondary pressure reducer downstream of the tank and a secondary pressure regulator intermediate the secondary reducer and the face mask and primary and secondary sensors connected to the face mask and respectively responsive to said pressure valves for respectively actuating the regulators.

2. Apparatus according to claim 1, including a helmet having forward portion containing the face mask and an occipital portion having inflatable means, manually operated pump means carried by the helmet and connected to and for inflating the inflatable means for causing the face mask to seat against the user's face, and the pump means including a valve selectively operative by the user to deflate the bladder.

* * * * *